US011959484B2

(12) United States Patent
Qiu et al.

(10) Patent No.: US 11,959,484 B2
(45) Date of Patent: Apr. 16, 2024

(54) DIRECT DRIVE REFRIGERANT SCREW COMPRESSOR WITH REFRIGERANT LUBRICATED BEARINGS

(71) Applicant: Carrier Corporation, Palm Beach Gardens, FL (US)

(72) Inventors: Yifan Qiu, Manlius, NY (US); David M. Rockwell, Cicero, NY (US); Amit Vaidya, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 150 days.

(21) Appl. No.: 16/973,710

(22) PCT Filed: May 20, 2020

(86) PCT No.: PCT/US2020/033675
§ 371 (c)(1),
(2) Date: Dec. 9, 2020

(87) PCT Pub. No.: WO2020/236852
PCT Pub. Date: Nov. 26, 2020

(65) Prior Publication Data

US 2022/0074415 A1 Mar. 10, 2022

Related U.S. Application Data

(60) Provisional application No. 62/850,328, filed on May 20, 2019.

(51) Int. Cl.
*F04C 29/02* (2006.01)
*F04C 18/16* (2006.01)
*F25B 31/00* (2006.01)

(52) U.S. Cl.
CPC ..... *F04C 29/02* (2013.01); *F04C 18/16* (2013.01); *F25B 31/002* (2013.01);
(Continued)

(58) Field of Classification Search
CPC ..... F04C 29/02; F04C 18/16; F04C 2240/20; F04C 2240/30; F04C 2240/50; F25B 31/002
See application file for complete search history.

(56) References Cited

U.S. PATENT DOCUMENTS 3,931,718 A 1/1976 Haselden
4,553,399 A 11/1985 Noda et al.
(Continued)

FOREIGN PATENT DOCUMENTS

CN 105392996 A 3/2016
CN 106133316 B 4/2020
(Continued)

OTHER PUBLICATIONS

ISR/WO; PCT/US2020/033675; dated Aug. 24, 2020; 15 pages.
(Continued)

*Primary Examiner* — Shafiq Mian
(74) *Attorney, Agent, or Firm* — CANTOR COLBURN LLP

(57) ABSTRACT

Disclosed is a direct-drive refrigerant screw compressor, having: a housing; a compression chamber in the housing; a pair of rotors, each rotor of the pair of rotors being rotationally disposed in the compression chamber and including an outer surface with a screw-geared profile; wherein, for each rotor, the compressor includes: a plurality of bearing packs disposed within a respective plurality of bearing chambers; a working fluid disposed within each of the plurality of bearing chambers, the working fluid providing oil-free lubrication to the plurality of bearing packs; a plurality of bearing lubrication ports extending through the housing and into each of the plurality of bearing chambers,
(Continued)

and configured for injecting the working fluid into each of the plurality of bearing chambers when the compressor is running.

14 Claims, 9 Drawing Sheets

(52) U.S. Cl.
CPC ..... *F04C 2240/20* (2013.01); *F04C 2240/30* (2013.01); *F04C 2240/50* (2013.01)

(56) References Cited

U.S. PATENT DOCUMENTS

| | | | | |
|---|---|---|---|---|
| 5,050,389 | A | 9/1991 | Wigore et al. | |
| 5,653,585 | A * | 8/1997 | Fresco | F25B 1/047 418/94 |
| 5,881,564 | A | 3/1999 | Kishimoto et al. | |
| 6,564,560 | B2 | 5/2003 | Butterworth et al. | |
| 8,104,298 | B2 | 1/2012 | Sishtla | |
| 8,360,650 | B2 | 1/2013 | Morales Espejel et al. | |
| 2004/0050081 | A1 * | 3/2004 | Tsuboi | F25B 31/008 62/193 |
| 2008/0245082 | A1 * | 10/2008 | Sishtla | F04D 29/058 62/468 |
| 2011/0016895 | A1 * | 1/2011 | Sishtla | F04F 5/54 62/115 |
| 2011/0174009 | A1 * | 7/2011 | Iizuka | F16C 33/109 62/468 |
| 2012/0207634 | A1 | 8/2012 | Heger et al. | |
| 2013/0052072 | A1 | 2/2013 | Smith et al. | |
| 2016/0312781 | A1 | 10/2016 | Shoulders | |
| 2017/0097007 | A1 | 4/2017 | Sishtla | |
| 2018/0058452 | A1 * | 3/2018 | Yuki | F04C 29/12 |
| 2018/0128520 | A1 | 5/2018 | Lapp et al. | |
| 2018/0136101 | A1 | 5/2018 | More et al. | |
| 2019/0178537 | A1 | 6/2019 | Nieforth et al. | |
| 2019/0271491 | A1 * | 9/2019 | Sishtla | F04D 29/4213 |

FOREIGN PATENT DOCUMENTS

| | | | |
|---|---|---|---|
| EP | 0664424 | B1 | 6/1999 |
| EP | 1119731 | B1 | 3/2003 |
| EP | 1400765 | A2 | 3/2004 |
| EP | 1729055 | B1 | 7/2008 |
| EP | 2607633 | B1 | 11/2017 |
| EP | 3120022 | B1 | 2/2018 |
| JP | 2006313044 | A | 11/2006 |
| JP | 2010043589 | A | 2/2010 |
| JP | 2014129962 | A | 7/2014 |
| JP | 2018136101 | A1 | 5/2018 |
| WO | 2015142825 | A1 | 9/2015 |
| WO | 2018038926 | A1 | 3/2018 |

OTHER PUBLICATIONS

First Office Action issued in Chinese Application No. 2023122702204180 dated Dec. 27, 2023; 18 pages; with machine translation.

* cited by examiner

DIRECT DRIVE REFRIGERANT SCREW COMPRESSOR WITH REFRIGERANT LUBRICATED BEARINGS

CROSS REFERENCE TO RELATED APPLICATIONS

This is a US National Stage of Application No. PCT/US2020/033675, filed on May 20, 2020, which claims the benefit of Provisional Application No. 62/850,328 filed May 20, 2019, the disclosures of which are incorporated herein by reference.

BACKGROUND

The disclosure relates generally to compressor systems and, more specifically, to a direct drive refrigerant screw compressor using refrigerant lubrication of one or more components thereof.

Refrigeration systems are utilized in many applications to condition an environment. The cooling or heating load of the environment may vary with ambient conditions, occupancy level, other changes in sensible and latent load demands, and with temperature and/or humidity changes.

Refrigeration systems typically include a compressor to deliver compressed refrigerant to a condenser. From the condenser, the refrigerant travels to an expansion valve and then to an evaporator. From the evaporator, the refrigerant returns to the compressor to be compressed.

A direct drive screw compressor in an HVAC chiller application has a driving (male) rotor and a driven (female) rotor. An electric motor drives the driving rotor to rotate. The driving rotor then drives the driven rotor by way of meshing. The meshing process requires direct contact of the rotors at contact locations. Lubrication is necessary to protect both rotors and decrease the friction during operation.

In addition, the rotors in a screw compressor in HVAC chiller applications are supported by rolling element bearings. These bearings may be lubricated using oil because of a high viscosity requirement of bearing lubricant. After passing through the bearings, oil is mixed with refrigerant in the compression process to be carried out of the compressor.

BRIEF DESCRIPTION

Disclosed is a direct-drive refrigerant screw compressor, comprising: a housing; a compression chamber in the housing; a pair of rotors, each rotor of the pair of rotors being rotationally disposed in the compression chamber and including an outer surface with a screw-geared profile; wherein, for each rotor, the compressor includes: a plurality of bearing packs disposed within a respective plurality of bearing chambers; a working fluid disposed within each of the plurality of bearing chambers, the working fluid providing oil-free lubrication to the plurality of bearing packs; a plurality of bearing lubrication ports extending through the housing and into each of the plurality of bearing chambers, and configured for injecting the working fluid into each of the plurality of bearing chambers when the compressor is running.

In addition to one or more of the above features, or as an alternate, for each rotor: the plurality of bearing lubrication ports include a respective plurality flow control orifices.

In addition to one or more of the above features, or as an alternate, for each rotor: the plurality of bearing chambers include a forward bearing chamber and an aft bearing chamber; and the plurality of bearing lubrication ports include a forward bearing lubrication port and an aft bearing lubrication port configured for directing the working fluid into the respective plurality of bearing chambers.

In addition to one or more of the above features, or as an alternate, for each rotor: the compressor includes a lubricant drain port for draining the working fluid from the plurality of bearing chambers when the compressor is running.

In addition to one or more of the above features, or as an alternate, for each rotor: the lubricant drain port extends into the aft bearing chamber and is fluidly connected to the forward bearing chamber through the compression chamber.

Further disclosed is a refrigerant system comprising: a condenser; and a direct-drive refrigerant screw compressor having one or more of the above disclosed features; and a condenser conduit fluidly connecting condenser to the plurality of bearing lubrication ports.

In addition to one or more of the above features, or as an alternate, the condenser conduit includes a forward branch and an aft branch for injecting in parallel the working fluid to each forward bearing chamber and each aft bearing chamber in the compressor; and each branch includes a plurality of sub-branches for injecting in parallel the working fluid to the bearing chambers on each branch.

In addition to one or more of the above features, or as an alternate, the system further comprises an evaporator; and an evaporator conduit fluidly connected between the evaporator and the lubricant drain port.

Further disclosed is a method of directing working fluid in a direct-drive refrigerant screw compressor, wherein for each rotor of a pair of rotors in the compressor, the method comprises: receiving working fluid at a plurality of bearing lubrication ports in a housing of the compressor, wherein the working fluid is oil-free; and directing the working fluid from the plurality of bearing lubrication ports to a plurality of bearing chambers; and when the compressor is running, lubricating a plurality of bearing packs in the respective plurality of bearing chambers with the working fluid.

In addition to one or more of the above features, or as an alternate, the method further comprises: controlling flow through the plurality of bearing lubrication ports with a respective plurality of flow control orifices.

In addition to one or more of the above features, or as an alternate, the method further comprises: injecting the working fluid into a forward bearing chamber from a forward bearing lubrication port and an aft bearing chamber from an aft bearing lubrication port.

In addition to one or more of the above features, or as an alternate, the method further comprises for each rotor: draining the working fluid through a lubricant drain port from the plurality of bearing chambers when the compressor is running.

In addition to one or more of the above features, or as an alternate, for each rotor, the forward and aft bearing chambers are fluidly connected through the compression chamber, and the lubricant drain port is disposed in the aft bearing chamber; and the method comprises: draining the working fluid from each bearing chamber through the lubricant drain port in the aft bearing compartment.

In addition to one or more of the above features, or as an alternate, the method further comprises: transporting the working fluid from a condenser of a refrigeration system to the plurality of bearing lubrication ports.

In addition to one or more of the above features, or as an alternate, the method further comprises: transporting the working fluid in the condenser conduit so that the working fluid is injected in parallel to each forward bearing chamber and each aft bearing chamber in the compressor.

In addition to one or more of the above features, or as an alternate, the method further comprises for each rotor: transporting the working fluid from the lubrication drain port to an evaporator in the refrigeration system.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
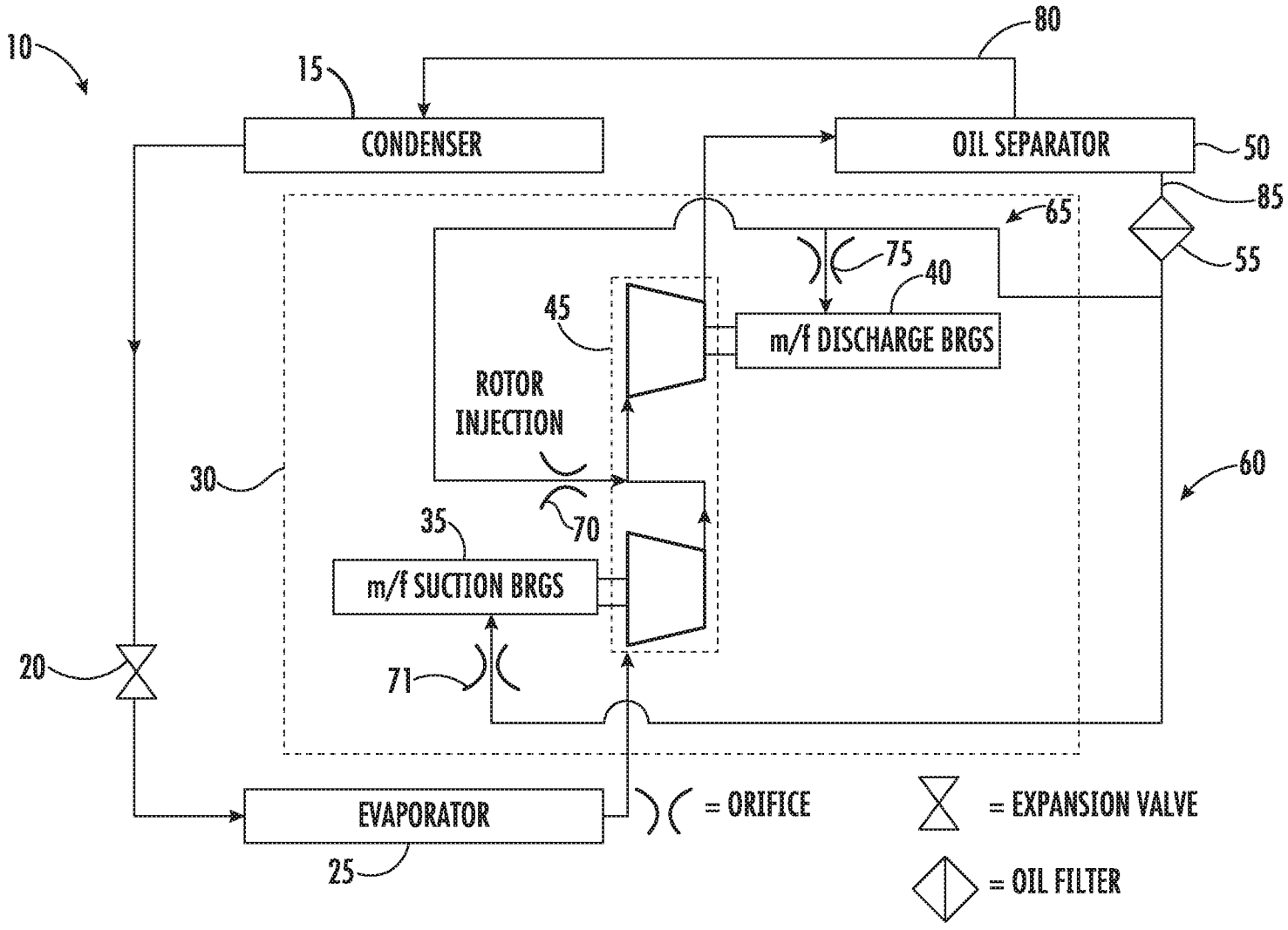
FIG. 1 is a refrigerant system in which features of the disclosed embodiments may be utilized.

Described herein are systems and methods for lubricating components of a compressor in a refrigeration system. FIG. 1 illustrates a refrigeration system 10 that is an oil lubricated system. The system 10 includes a condenser 15 that receives a high pressure gaseous form of the working fluid, ejects heat from the working fluid, for example to the environment, and outputs a high pressure liquid form of the working fluid. Downstream of the condenser 15 is an expansion valve 20 that receives the high pressure liquid form of the working fluid and outputs a low pressure liquid form of the working fluid. Downstream of the expansion valve 20 is an evaporator 25 that receives the low pressure liquid form of the working fluid, transfers heat to the working fluid, thereby conditioning warm air, and outputs a low pressure gaseous form of the working fluid. Downstream of the evaporator 25 is a compressor 30 that receives the low pressure gaseous form of the working fluid and outputs a high pressure gaseous form of the working fluid.

The compressor 30 may be a screw compressor that includes suction bearings 35, discharge bearings 40, and a set of rotors 45 therebetween. Both sets of bearings 35, 40 and the rotors 45 require some form of lubrication. Lubricating oil is provided by an oil separator 50. The oil separator 50 transfers oil to an oil filter 55. The oil filter 55 transfers oil a first portion of oil 60 to one orifice 71, e.g, in the compressor housing, fluidly connected to the suction bearings 35. A second portion of oil 65 is distributed in parallel to one orifice 70, e.g., in the compressor housing, fluidly connected to the rotors 45 and another orifice 75, e.g., in the compressor housing, fluidly connected to the discharged bearings 40. The oil then mixes with the working fluid in the compressor 30.

Output from the compressor 30 is directed to the oil separator 50. The oil separator 50 separates the output from the compressor into a first portion 80 that is the working fluid directed the condenser 15. The second portion 85 is the lubricant directed to the filter 55. Unless otherwise indicated herein, for each embodiment all flows between the system components that are separately referred to are fluidly transferred in respective conduit lines. It is to be appreciated that fluid branches that are branched upstream or downstream of the orifices 70, 75 in the housing of the compressor 30 may be branched in conduit exterior to the housing of the compressor 30.

Viscosity of oil lubricant may be reduced when mixed with the working fluid. Both bearing load carrying capacity and oil sealing characteristics are dependent upon the oil viscosity. As such, due to lower viscosity, moving components, such as bearings and rotors, in some systems may experience increased wear during operation. In addition, separating lubricating oil from refrigerant requires the use and maintenance of additional equipment such as the oil separator and related filter. In addition, because the oil separation process cannot completely remove the oil from refrigerant, excessive oil may decrease heat transfer efficiency in the system and lower the overall system capacity. Oil may be saturated with refrigerant in the separator. The separation process is often unable to adequately lower the refrigerant content in the oil.

In view of the above challenges FIGS. 2-7 disclose embodiments in which an oil separator and oil filter may be avoided. More specifically, turning to FIG. 2, disclosed is a refrigerant system 100 (a chiller) applicable to each of the embodiments disclosed herein. The system 100 includes a condenser 110, an expansion valve 112, an evaporator 114, and a dual rotor refrigerant screw compressor 115 (compressor 115), which is a direct drive compressor. The compressor 115 includes two screw rotors 150. The rotors 150 are configured in the compressor 115 with a suction side 140*a* and discharge side 140*b* (illustrated schematically in FIG. 2). The compressor 115 includes bearing packs 190 including a suction side bearing pack 190*a* and a discharge side bearing pack 190*b*. The suction side bearing pack 190*a* may be referred to herein as a forward bearing pack and the discharge side bearing pack 190*b* may be referred to herein as an aft bearing pack.

The condenser feeds first portion 116 of a working fluid to the expansion valve 112 and, in parallel, a second portion 120 of the working fluid 120 to the compressor 115. The working fluid consists of refrigerant form a condenser conduit 125 to the compressor 115 for providing lubrication to components of the compressor 115 as described below.

The second portion 120 of the working fluid is distributed in parallel to a first branch 121 and a second branch 122. The first branch 121 is distributed in parallel to a third branch 123 and a fourth branch 124. The third branch 123 delivers the working fluid through one or more orifices 126, e.g. in the compressor housing 130, to the suction side bearing pack 190*a*. The fourth branch 124 delivers the working fluid through another one or more orifices 127, e.g. in the compressor housing 130, to the rotors 150. The second branch 122 delivers the working fluid to a further one or more orifices 128, e.g. in the compressor housing 130, to the branch side bearing pack 190*b*.

From the suction side bearing pack 190*a*, the working fluid flows directly into the rotors 150 with the working fluid from the evaporator 114. This may occur within the compressor housing 130. From the discharge side bearing pack 190*b* the working fluid flows to the evaporator 114 to mix with fluid therein and then be redirected to the rotors 150 of the compressor 115. This may occur by the working fluid exiting the compressor housing 130 from the discharged side bearings 190*b* and being directed thereafter to the evaporator 114. Unless otherwise indicated herein, for each embodiment all flows between the system components that are separately referred to are fluidly transferred in respective conduit lines. It is to be appreciated that fluid branches that are branched upstream or downstream of the orifices 126, 127, 128 in the compressor housing 130 may be branched in conduit exterior to the compressor housing 130.

Figure 3:
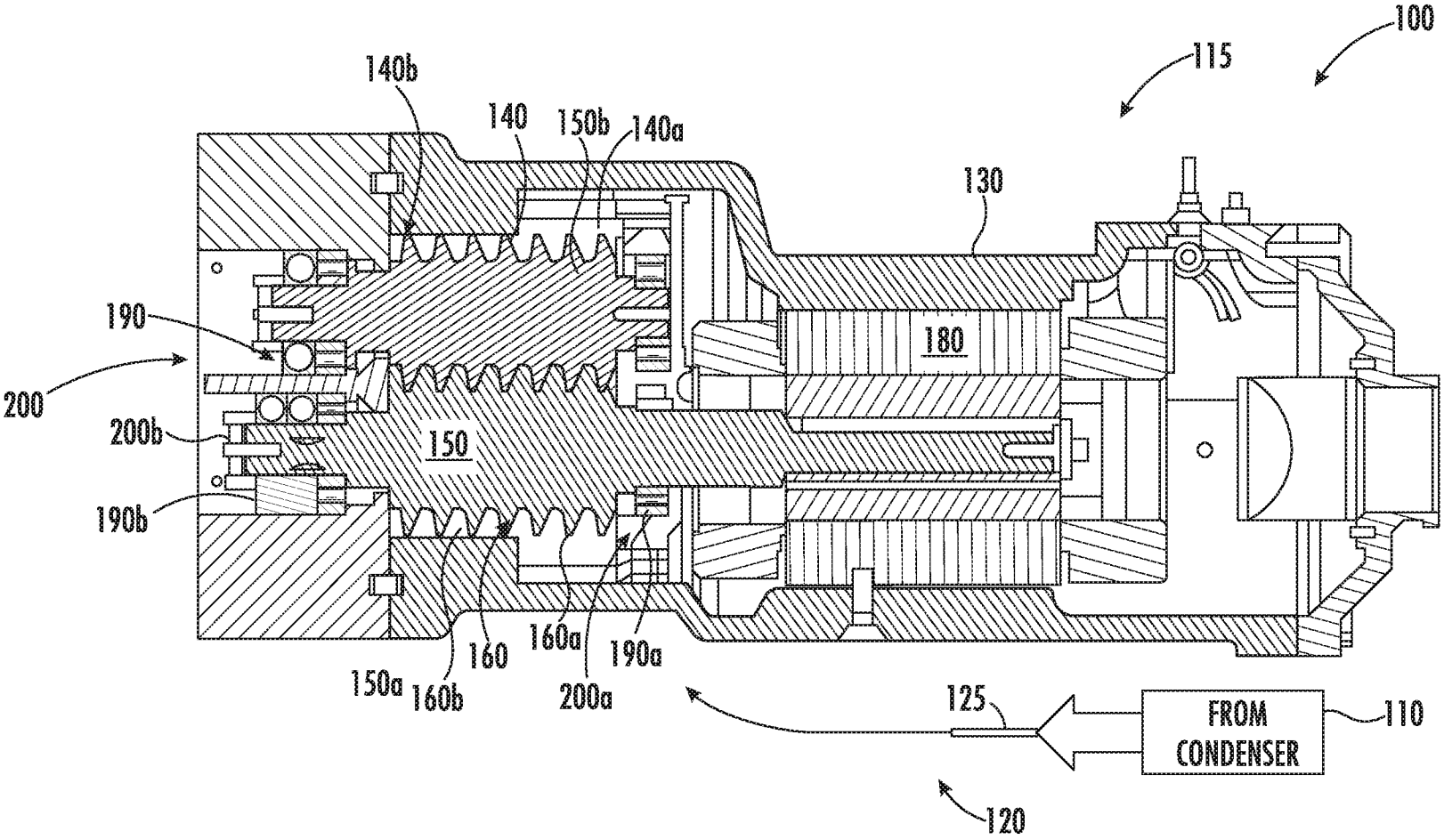
FIG. 3 is a direct-drive screw compressor according to one embodiment.
Figure 4:
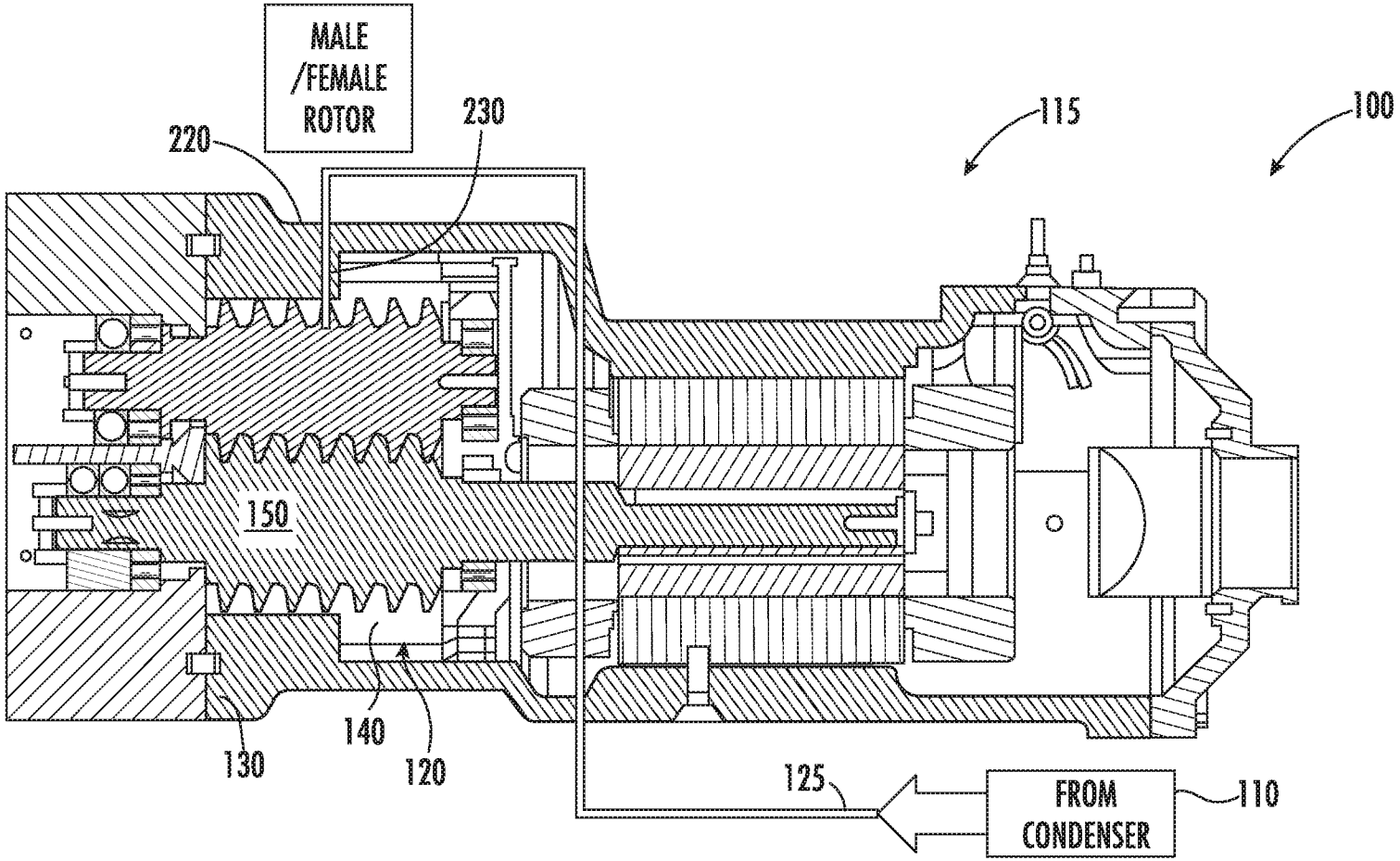
FIG. 4 is a direct-drive screw compressor according to one embodiment.
Figure 5:
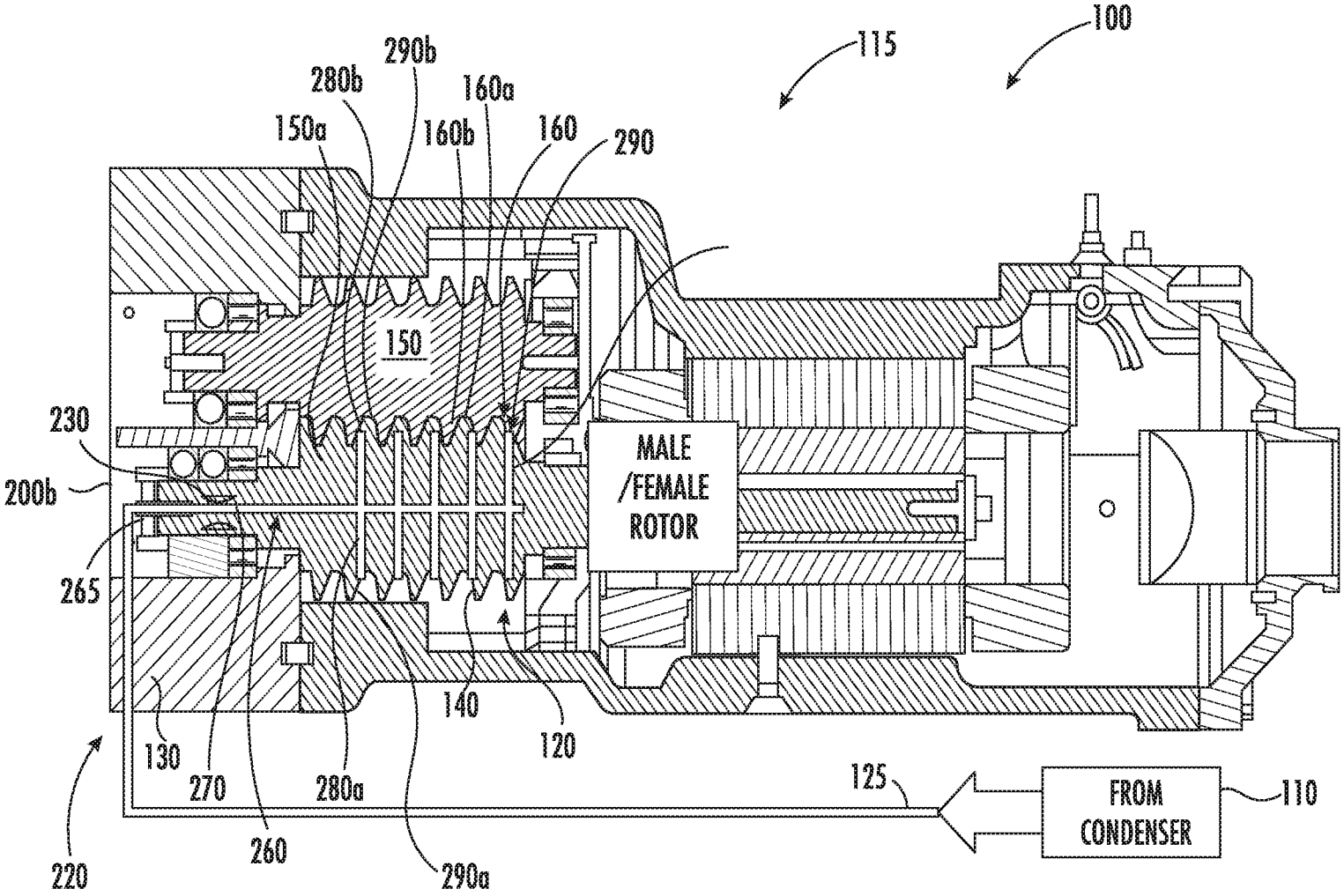
FIG. 5 is a direct-drive screw compressor according to one embodiment.
Figure 6:
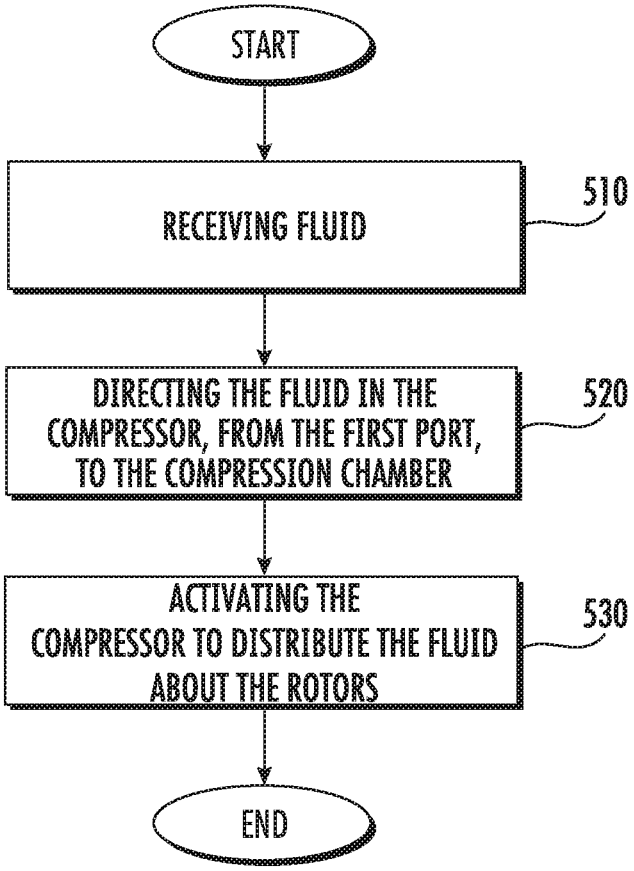
FIG. 6 is a method of transporting refrigerant as a lubricant with the compressor of FIG. 4.

The features of the compressor are illustrated more specifically, for example, in FIGS. 3-5. Turning now to FIG. 3, the compressor 115 includes the housing 130. A compression chamber 140 is disposed in the housing 130. The compression chamber 140 has a forward end 140*a* and an aft end 140*b* which are respective suction and discharge sides of the compression chamber 140. For simplicity, inlet and outlet ports in the housing 130 for fluidly communicating working fluid 120 in the refrigeration system 100 are not illustrated in FIG. 3.

The compressor 115 includes the plurality of rotors generally referred to as 150, including the first rotor 150*a* and the second rotor 150*b*, rotationally disposed in the compression chamber 140. Each rotor 150 includes an outer surface 160 with a screw-geared profile, for example, having an alternating plurality of peaks 160*a* and plurality of troughs 160*b*, for example, in cross sectional view. The plurality of rotors 150 intermesh and form compression volumes within the compression chamber 140. The first rotor 150*a* is a driven rotor and the second rotor 150*b* is a drive rotor, driven by a motor 180.

For each rotor 150, the compressor 115 includes the plurality of bearing packs generally referred to as 190 including the forward bearing pack generally referred to as 190*a* and the aft bearing pack generally referred to as 190*b*. For each rotor 150, the plurality of bearing packs 190 may disposed within a respective plurality of bearing chambers generally referred to as 200. The bearing chambers 200 may be structural portions of the housing 130 in or proximate the compression chamber 140 configured to securely position the respective bearing packs 190. The bearing chambers 200 may including a forward bearing chamber generally referred to as 200*a* and an aft bearing chamber generally referred to as 200*b*. The bearing chambers 200 may be fluidly connected with each other through the compression chamber 140.

Turning now to FIG. 4, an embodiment of the refrigeration system 100 is illustrated. The embodiment of FIG. 4 includes all of the features illustrated in the system 100 illustrated in FIG. 3. In FIG. 4, the fluid 120 is disposed within the compression chamber 140. A first port 220 extends through the housing 130 for directing fluid toward the compression chamber 140. The first port 220 is connected by the condenser conduit 125 to the condenser 110. According to an embodiment, the first port 220 includes a flow control orifice 230. This may be used to reduce a flow volume or rate from the condenser 110 as may be needed.

In FIG. 4, the first port 220 extends directly into the compression chamber 140. Within the compression chamber 140, the first port 220 delivers working fluid 120 between the two rotors 150 so that the working fluid 120 flows to meshing points between the two rotors 150. In one embodiment, the first port 220 is proximate one rotor 150 (the second rotor 150*b*) of the compressor 115 and distal the other rotor 150 (the first rotor 150*a*). Identifying the one rotor 150 as the second rotor 150*b* and the other rotor 150 as the first rotor 150*a* in the embodiment in FIG. 4 is for example only and not intended on limiting the scope of the embodiments. Rotation of the rotors 150 distributes the fluid 120 about the rotors 150.

Turning now to FIG. 5, an embodiment of the refrigeration system 100 is illustrated. The embodiment of FIG. 5 includes all of the features illustrated in the system 100 illustrated in FIG. 3. In FIG. 5, the fluid 120 is disposed within the compression chamber 140. A first port 220, configured differently than the first port 220 in the embodiment of FIG. 4, extends through the housing 130. In FIG. 5, the first port 220 fluidly connects with a passage 260 within one rotor 150 (the first rotor 150*a*) for directing fluid toward the compression chamber 140. Identifying the one rotor 150 as the first rotor 150*a*, and thus the other rotor 150 as the second rotor 150*a*, in the embodiment in FIG. 5 is for example only and not intended on limiting the scope of the embodiments. The first port 220 is connected by the condenser conduit 125 to the condenser 110. According to an embodiment, the passage 260 includes a flow control orifice 230, which may be the same as the above introduced flow control orifice 230. This may be used to reduce a flow volume or rate from the condenser 110 as may be needed.

The passage 260 may be an internal passage in the one rotor 150. The passage 260 may be fluidly connected between an axial aft port 265 in the one rotor 150 and the outer surface 160 of the one rotor 150. The aft port 265 may be in the respective aft bearing chamber 200*b*, though this placement is not intended to be limiting.

The passage 260 may include an axial segment 270 forming a blind hole in the one rotor 150 and a radial segment generally referred to as 280 fluidly connected between the axial segment 270 and a surface port generally referred to as 290 on the outer surface 160 of the one rotor 150. In one embodiment, the passage 260 may include a plurality of the radial segments 280 fluidly connected to a respective plurality of the surface ports 290 on the outer surface 160 of the one rotor 150. This configuration may provide a greater distribution of the fluid 120 about each rotor 150 as compared with, for example, a single fluid 120 port.

In one embodiment, the plurality of the surface ports 290 may be staggered at regular intervals along the outer surface 160, for example, at or proximate the plurality of alternating peaks 160*a* or troughs 160*b*. This configuration may provide an even distribution of fluid 120 around the outer surface 160 of the each rotor 150. In one embodiment the plurality of the radial segments 280 may each include a plurality of opposing radial portions 280*a*, 280*b* extending to a respective plurality of the radial ports 290*a*, 290*b* on the outer surface 160 of the one rotor 150. This configuration may provide an ability to quickly distribute fluid 120 around the outer surface 160 of the rotors 150.

Turning to FIG. 5, a method is disclosed of directing fluid 120 in the compressor 115 for the embodiment illustrated in FIG. 3. The method includes block 510 of receiving the fluid 120 at the first port 220 of the housing 130. In an embodiment, block 510 further includes controlling flow in the first port 220 through a flow control orifice 230 (which may be the same as orifice 127 in FIG. 2). The method further includes block 520 of directing the fluid 120 in the compressor 115, from the first port 220, to the compression chamber 140. According to an embodiment, block 520 further includes injecting the fluid 120 from the first port 220 directly into the compression chamber 140 proximate one rotor 150 and distal the other rotor 150. At block 530 the compressor is activated to distribute the fluid about the rotors 150.

Figure 7:
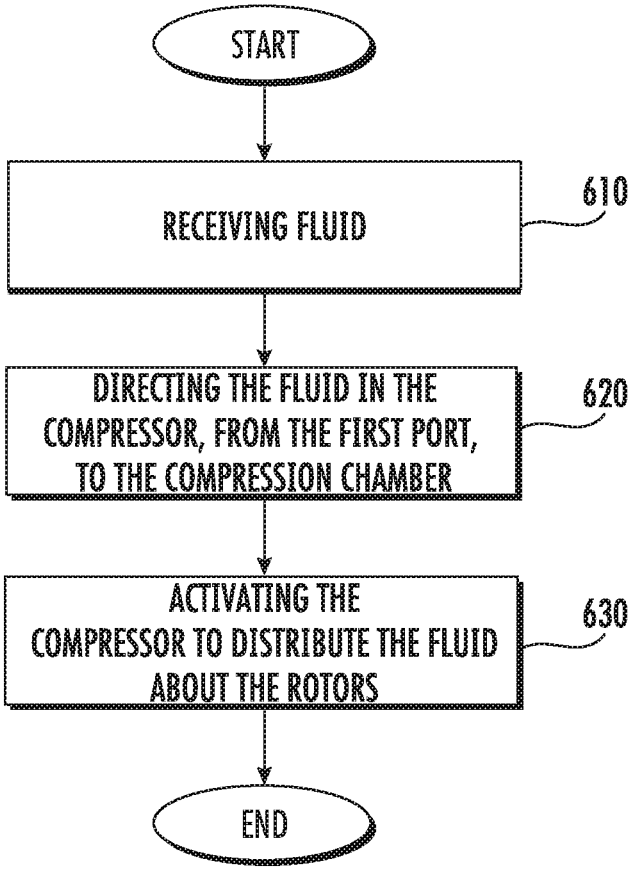
FIG. 7 is a method of transporting refrigerant as a lubricant with the compressor of FIG. 5.

Turning to FIG. 7, a method is disclosed of directing fluid 120 in the compressor 115 for the embodiment illustrated in FIG. 5. Similar to the method in FIG. 6, the method of FIG. 7 includes block 610 of receiving the fluid 120 at the first port 220 of the housing 130. The method of FIG. 7 includes block 620 of directing the fluid 120, from the first port 220, to the compression chamber 140. In an embodiment, block 620 further includes controlling flow in the passage 260 through a flow control orifice 230. In an embodiment, block 620 further includes injecting the fluid 120 through the first port 220, through a passage 260 in one rotor 150, and into the compression chamber 140. Then, at block 630 the compressor is activated to distribute the fluid about the rotors 150.

Thus, in the above disclosed embodiments, the working fluid 120 is drawn from a chiller condenser and used to provide lubrication to the compressor and more specifically to the screw rotors. The liquid can be injected direct from port(s) on the housing close to the rotor meshing locations or through a passage inside the driving rotor. The liquid flow can be adjusted by using flow restriction devices, such as a flow control orifice. The embodiments enable the utilization of pure refrigerant as the working fluid 120 in the components of the system 100, including the condenser 110, evaporator 114, etc.

Figure 8:
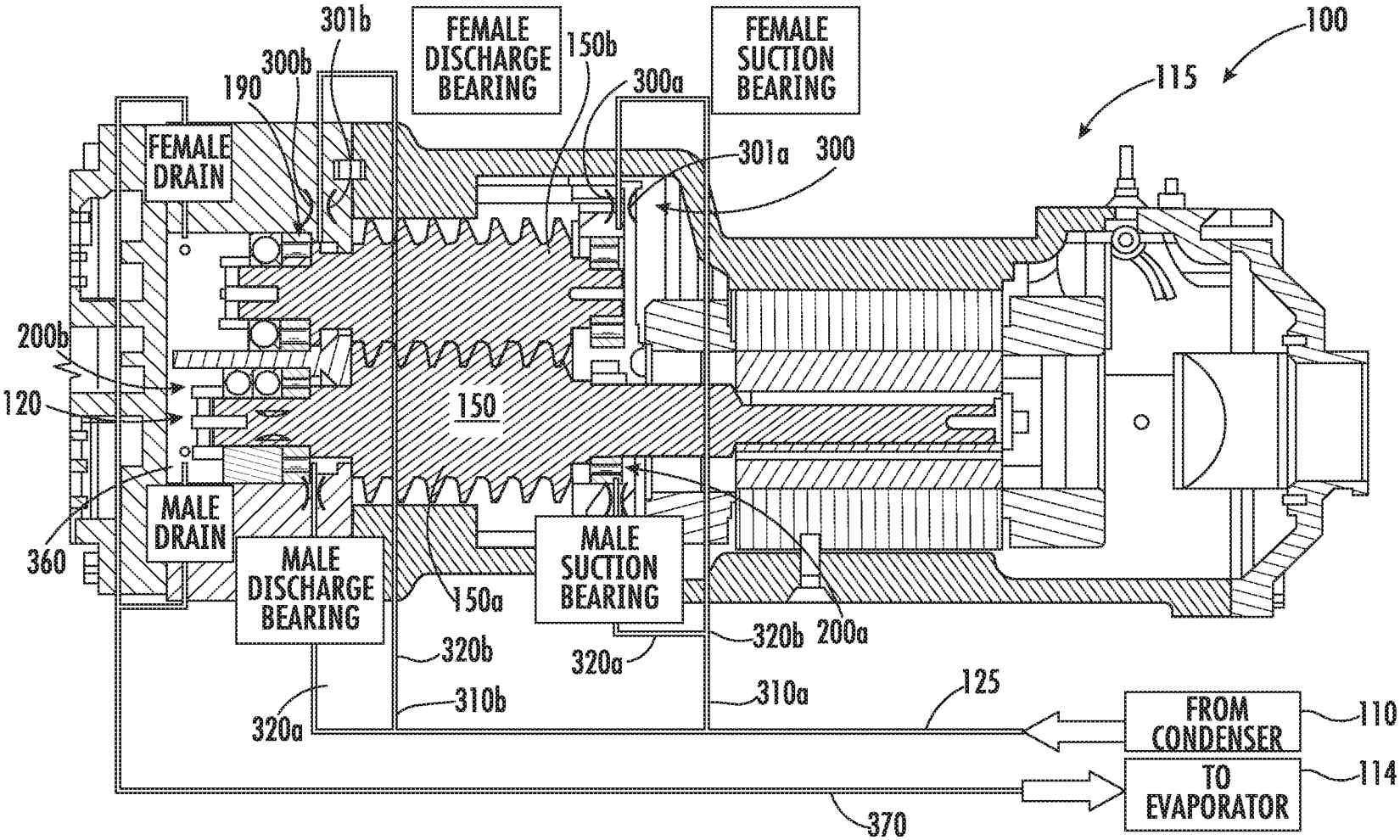
FIG. 8 is a direct-drive screw compressor according to one embodiment.

Turning now to FIG. 8 a further embodiment of a refrigerant system 100 is illustrated. The embodiment of FIG. 8 includes all of the features illustrated in the system 100 illustrated in FIG. 3. In FIG. 8, the fluid 120 is disposed within each of the plurality of bearing chambers 200 for providing lubrication to the plurality of bearing packs 190, thus providing pure refrigerant lubricated (PRL) bearings. A plurality of bearing lubrication ports generally referred to as 300 extend through the housing 130 and into each of the plurality of bearing chambers 200.

Figure 2:
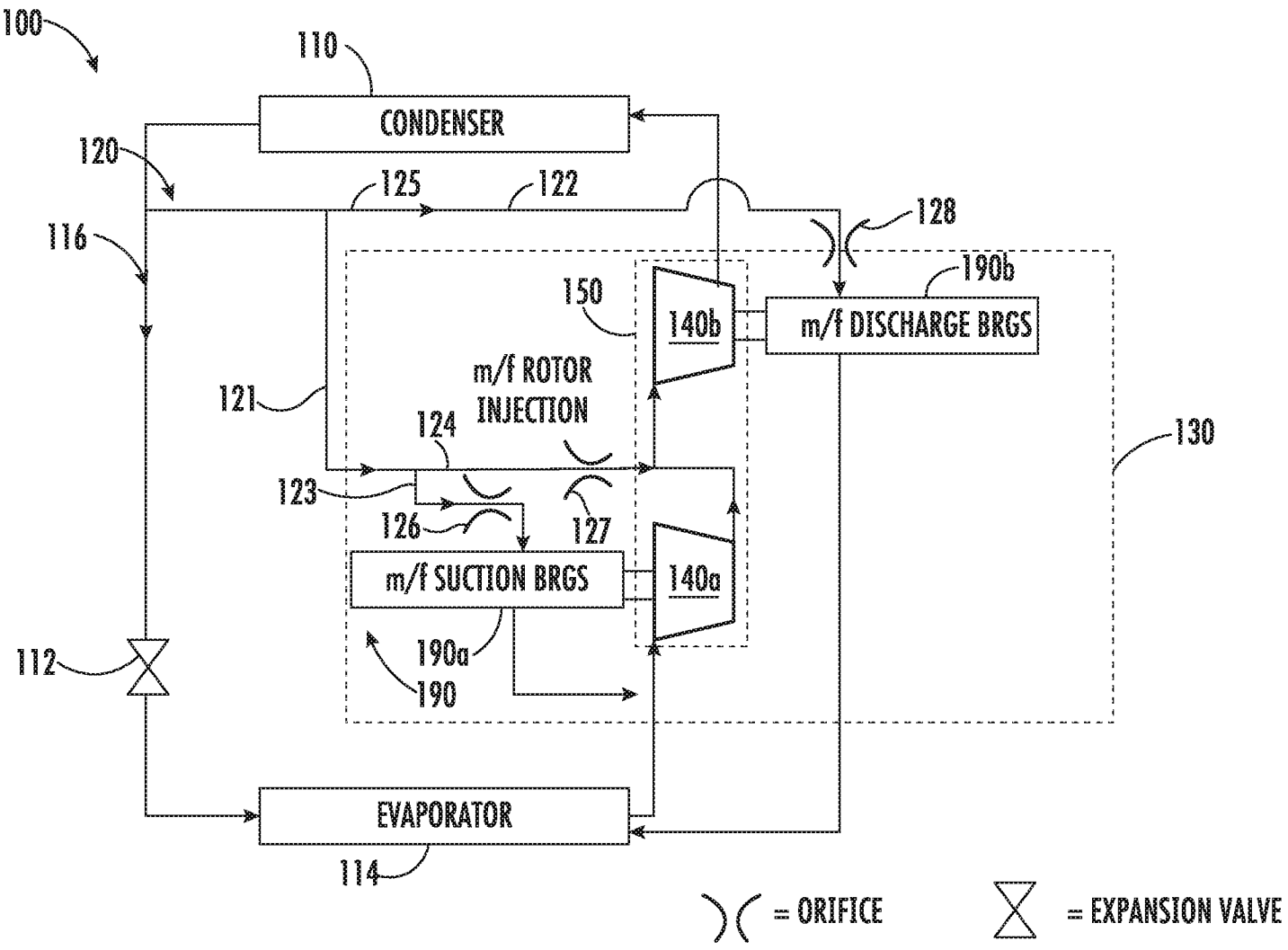
FIG. 2 is a refrigerant system according to a disclosed embodiment.

In addition, a suction side (upstream) lubrication port 300*a* includes a suction side (upstream) flow control orifice 301*a* (which may be the same as orifice 126 in FIG. 2). A discharge side (downstream) lubrication port 300*b* includes a discharge side (downstream) flow control orifice 301*b* (which may be the same as orifice 128 in FIG. 2).

The condenser conduit 125 fluidly connects the condenser 110 to the plurality of bearing lubrication ports 300. From this configuration, the plurality of bearing lubrication ports 300 are configured for injecting the fluid 120 into each of the plurality of bearing chambers 200 when the compressor 115 is running, to thereby provide lubrication to the plurality of bearing packs 190. In one embodiment the plurality of bearing lubrication ports 300 include a respective plurality flow control orifices 230 to reduce a flow volume or rate from the condenser 110 as may be needed.

In one embodiment, the condenser conduit 125 includes a forward branch 310*a* and an aft branch 310*b* for injecting in parallel the fluid 125 to each forward bearing chamber 200*a* and each aft bearing chamber 200*b* in the compressor. Each branch 310*a*, 310*b* includes a plurality of sub-branches generally referred to as 320 for injecting in parallel the fluid to the bearing chambers 200 on each branch 310*a*, 310*b*. This configuration enables the condenser 110 to feed the fluid 120 to the compressor 115 from the single condenser conduit 125.

As further illustrated in FIG. 8, for each rotor 150 the compressor 115 includes a lubricant drain port generally referred to as 360 fluidly connected to the evaporator by an evaporator conduit 370. The lubricant drain port 360 is for draining the fluid 120 from the plurality of bearing chambers 200 of the respective rotor 150 when the compressor 115 is running. In one embodiment, each lubricant drain port 360 extends into the respective aft bearing chamber 200*b* and is fluidly connected to the respective forward bearing chamber 200*a* through the respective aft bearing chamber 200*b*.

Figure 9:
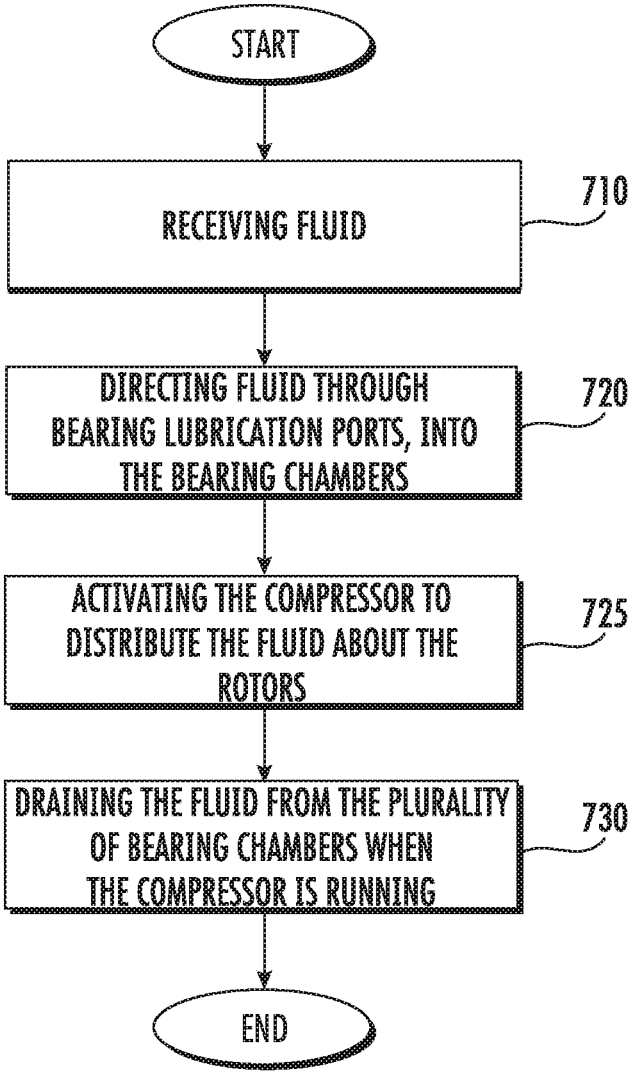
FIG. 9 is a method of transporting refrigerant as a lubricant with the compressor of FIG. 8.

As illustrated in FIG. 9, a further method is disclosed of directing fluid 120 in the compressor 115 in the refrigerant system 100. The method includes block 710 of receiving the fluid 120 from the compressor 115 in the refrigerant system 100, through a condenser conduit 125, at the plurality of bearing lubrication ports 300. The method includes block 720 of directing the fluid 120 through the plurality of bearing lubrication ports 300 to the plurality of bearing chambers 200. From this configuration the fluid 120 is injected, when the compressor 115 is running, to the plurality of bearing packs 190 in the respective plurality of bearing chambers 200. According to an embodiment, box 710 may further include controlling flow through the plurality of bearing lubrication ports 300 with a respective plurality of flow control orifices 230. Then, at block 725 the compressor is activated to distribute the fluid about the rotors 150. That is, the fluid 130 is inject to one side of the bearing packs 190 and is flow through the bearing packs 190 to lubricate each of the bearing packs 190.

According to an embodiment, for each rotor 150, the method includes block 730 of draining the fluid 120 through the lubricant drain port 360 from the plurality of bearing chambers 200 when the compressor 115 is running According to an embodiment, for each rotor 150 block 730 further includes draining the fluid 120 from the plurality of chambers 20 through the aft bearing chamber 200, into the evaporator conduit 370, and to the evaporator 114 in the refrigerant system 100.

With the above disclosed embodiments, for example in FIGS. 3, 8 and 9, pure refrigerant lubricated (PRL) bearings are used in a screw compressor to support the loads on the rotors. The PRL bearings operate with a relatively low viscosity lubricant, such as liquid refrigerant as the working fluid. The liquid refrigerant as the working fluid is drawn from the chiller condenser and injected directly to each individual bearings or pack of bearings. The liquid flow can be adjusted by using flow restriction devices, such as an orifice.

With the above disclosed embodiments, oil separation equipment on a chiller is no longer necessary. This configuration reduces the complexity of the chiller system. The chiller cost will be therefore reduced. The chiller heat transfer efficiency will therefore increase.

Accordingly, as indicated above, there are two kinds of fluids in a typical system: oil and a working fluid. Oil is typically used for lubricating bearings and rotors and for sealing. The working fluid, such as refrigerant, is typically used to transmit heat. According to the disclosed embodiments, the working fluid, instead of oil, is used for lubricating bearings and rotors.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

We claim:

1. A direct-drive refrigerant screw compressor, comprising:

a housing;

a compression chamber in the housing;

a pair of rotors including first and second rotors, each of the first and second rotors of the pair of rotors being rotationally disposed in the compression chamber and including an outer surface with a screw-geared profile;

wherein, for each of the first and second rotors, the compressor includes:

a plurality of bearing packs disposed within a respective plurality of bearing chambers;

a working fluid disposed within each of the plurality of bearing chambers, the working fluid providing oil-free lubrication to the plurality of bearing packs;

a plurality of bearing lubrication ports extending through the housing and into each of the plurality of bearing chambers, and configured for injecting the working fluid into each of the plurality of bearing chambers when the compressor is running, wherein the plurality of bearing chambers includes a forward bearing chamber and an aft bearing chamber; and the plurality of bearing lubrication ports includes, for directing the working fluid into the respective plurality of bearing chambers:

for the first rotor, a first forward bearing lubrication port and a first aft bearing lubrication port; and for the second rotor, a second forward bearing lubrication port and a second aft bearing lubrication port, and wherein the plurality of bearing lubrication ports includes a respective plurality flow control orifices to reduce a flow volume or rate from a condenser, wherein the respective plurality flow control orifices are defined in the compressor housing.

2. The compressor of claim 1, wherein for each of the first and second rotors:

the compressor includes a lubricant drain port for draining the working fluid from the plurality of bearing chambers when the compressor is running.

3. The compressor of claim 2, wherein for each of the first and second rotors:

the lubricant drain port extends into the aft bearing chamber and is fluidly connected to the forward bearing chamber through the compression chamber.

4. A refrigerant system comprising:

a condenser; and a direct-drive refrigerant screw compressor, comprising:

a housing;

a compression chamber in the housing;

a pair of rotors including first and second rotors, each of the first and second rotors of the pair of rotors being rotationally disposed in the compression chamber and including an outer surface with a screw-geared profile;

wherein, for each of the first and second rotors, the compressor includes:

a plurality of bearing packs disposed within a respective plurality of bearing chambers;

a working fluid disposed within each of the plurality of bearing chambers for providing oil-free lubrication to the plurality of bearing packs;

a plurality of bearing lubrication ports extending through the housing and into each of the plurality of bearing chambers, and configured for injecting the working fluid into each of the plurality of bearing chambers when the compressor is running; and a condenser conduit fluidly connecting condenser to the plurality of bearing lubrication ports, wherein the plurality of bearing chambers includes a forward bearing chamber and an aft bearing chamber; and the plurality of bearing lubrication ports includes, for directing the working fluid into the respective plurality of bearing chambers:

for the first rotor, a first forward bearing lubrication port and a first aft bearing lubrication port; and for the second rotor, a second forward bearing lubrication port and a second aft bearing lubrication port, and wherein the plurality of bearing lubrication ports includes a respective plurality flow control orifices to reduce a flow volume or rate from a condenser, wherein the respective plurality flow control orifices are defined in the compressor housing.

5. The system of claim 4, wherein for each of the first and second rotors:

the compressor includes a lubricant drain port for draining the working fluid from the plurality of bearing chambers when the compressor is running.

6. The system of claim 5, wherein for each of the first and second rotors:

the lubricant drain port extends into the aft bearing chamber and is fluidly connected to the forward bearing chamber through the compression chamber.

7. The system of claim 6, wherein:

the condenser conduit includes a forward branch and an aft branch for injecting in parallel the working fluid to each forward bearing chamber and each aft bearing chamber in the compressor; and each branch includes a plurality of sub-branches for injecting in parallel the working fluid to the bearing chambers on each branch.

8. The system of claim 7, further comprising:

an evaporator; and an evaporator conduit fluidly connected between the evaporator and the lubricant drain port.

9. A method of directing working fluid in a direct-drive refrigerant screw compressor, wherein for each of first and second rotors of a pair of rotors in the compressor, the method comprises:

receiving working fluid at a plurality of bearing lubrication ports in a housing of the compressor, wherein the working fluid is oil-free; and directing the working fluid from the plurality of bearing lubrication ports to a plurality of bearing chambers; and when the compressor is running, lubricating a plurality of bearing packs in the respective plurality of bearing chambers with the working fluid, wherein the plurality of bearing chambers includes a forward bearing chamber and an aft bearing chamber; and the plurality of bearing lubrication ports includes, for directing the working fluid into the respective plurality of bearing chambers:

for the first rotor, a first forward bearing lubrication port and a first aft bearing lubrication port; and for the second rotor, a second forward bearing lubrication port and a second aft bearing lubrication port, and wherein the plurality of bearing lubrication ports includes a respective plurality flow control orifices to reduce a flow volume or rate from a condenser, wherein the respective plurality flow control orifices are defined in the compressor housing, and the method further comprises injecting the working fluid into a forward bearing chamber from the first and second forward bearing lubrication ports and an aft bearing chamber from the first and second aft bearing lubrication ports.

10. The method of claim 9, wherein for each of the first and second rotors the method includes:

draining the working fluid through a lubricant drain port from the plurality of bearing chambers when the compressor is running.

11. The method of claim 10, wherein:

for each of the first and second rotors, the forward and aft bearing chambers are fluidly connected through the compression chamber, and the lubricant drain port is disposed in the aft bearing chamber; and the method comprises:

draining the working fluid from each bearing chamber through the lubricant drain port in the aft bearing compartment.

12. The method of claim 11, wherein for each of the first and second rotors the method includes:

transporting the working fluid from a condenser of a refrigeration system to the plurality of bearing lubrication ports.

13. The method of claim 12, further comprising:

transporting the working fluid in the condenser conduit so that the working fluid is injected in parallel to each forward bearing chamber and each aft bearing chamber in the compressor.

14. The method of claim 13, wherein for each of the first and second rotors the method includes:

transporting the working fluid from the lubrication drain port to an evaporator in the refrigeration system.

* * * * *